United States Patent [19]

Chow

[11] Patent Number: 4,740,729

[45] Date of Patent: Apr. 26, 1988

[54] PLURAL-COLOR DISCHARGE LAMPS

[76] Inventor: Shing C. Chow, 12A Suffolk Road, Kowloon, Hong Kong

[21] Appl. No.: 37,724

[22] Filed: Apr. 13, 1987

[30] Foreign Application Priority Data

Apr. 22, 1986 [JP] Japan ..... 61-93177

[51] Int. Cl.[4] ..... H01J 61/06; H01J 61/35

[52] U.S. Cl. ..... 313/493; 313/607; 313/622; 315/169.1; 315/317

[58] Field of Search ..... 313/493, 491, 581, 607, 313/622, 631, 643; 315/317, 169.1

[56] References Cited

U.S. PATENT DOCUMENTS 4,625,152 11/1986 Nakai ..... 315/317
4,645,979 2/1987 Chow ..... 313/607 X
4,665,341 5/1987 Imamura et al. ..... 315/317 X

*Primary Examiner*—David K. Moore
*Assistant Examiner*—Sandra L. O'Shea
*Attorney, Agent, or Firm*—Dennison, Meserole, Pollack & Scheiner

[57] ABSTRACT

A discharge lamp has an outer discharge tube and an inner discharge tube. The outer tube includes an envelope of glass enclosing an inert gas, a first electrode mounted within the envelope, a second electrode formed of a transparent film deposited on the exterior surface of the envelope, and a fluorescent material coated on the interior surface of the envelope for producing a light in a desired color when a voltage is applied across the two electrodes. The inner tube is inserted in the outer tube and includes an envelope of glass enclosing an inert gas, a third electrode mounted within the envelope, the third electrode utilizing the second electrode of the outer tube as an opposite electrode for producing luminous discharge, and a fluorescent material coated on the interior surface of the envelope for producing a light in a color different from the one produced by the fluorescent material on the outer tube.

9 Claims, 5 Drawing Sheets

PLURAL-COLOR DISCHARGE LAMPS

BACKGROUND OF THE INVENTION

1. Field of the Invention

The present invention relates to discharge lamps for producing luminous signs such as characters, numerals and symbols, and more particularly to plural-color discharge lamps in which the luminous color may be sequentially varied.

2. Description of the Prior Art

In general, discharge lamps may comprise a glass tube which is filled with inert gas; a pair of electrodes, one of which is mounted within the glass tub and the other is formed of a transparent conductive film deposited on the exterior surface of the glass tube; and a fluorescent film coated on the interior surface of the glass tube and adapted to produce a light in a color as desired when a discharge voltage is applied across the electrodes. One of these lamps is disclosed, for example, in Japanese Laid-Open Patent Publication No. 58-111251.

As such conventional discharge lamps have produced only a single-color light, it has been impossible for a single discharge lamp to display characters, numerals, symbols or the like in different colors changed, for example, at certain time intervals. Thus, there have been certain limitations in improving the display effect of such lamps.

SUMMARY OF THE INVENTION

It is, accordingly, an object of the present invention to provide a plural-color discharge lamp in which the luminous color of the discharge lamp can be sequentially varied as desired so as to increase the display effect of characters, numerals, symbols or the like.

According to the present invention, there is provided a plural-color discharge lamp whose luminous color can be varied as desired. The discharge lamp comprises an outer discharge tube and an inner discharge tube. The outer discharge tube includes an elongated cylindrical envelope of dielectric material, an inert gas confined in the envelope, a first electrode mounted within one end of the envelope, a second electrode formed of a transparent conductive film deposited substantially on the entire exterior surface of the envelope, and a fluorescent material coated on the interior surface of the envelope and adapted to produce a light in a desired color when a voltage is applied across the two electrodes for luminous discharge. The inner discharge tube is inserted substantially over the entire length thereof in the outer discharge tube, and includes an elongated cylindrical envelope of dielectric material, an inert gas confined in the inner envelope, a third electrode mounted within one end of the inner envelope, the third electrode utilizing the second electrode of the outer discharge tube as an opposite electrode for producing luminous discharge, and a fluorescent material coated on the interior surface of the inner envelope and adapted to produce a light in a color different from the one produced by the fluorescent material coated on the interior surface of the envelope of the outer discharge tube.

In the plural-color discharge lamp thus constructed, when a discharge voltage is applied across the first and second electrodes, a luminous discharge is produced in the outer discharge tube, causing the outer discharge tube to produce a light in a color corresponding to the fluorescent material coated on the interior surface of the envelope.

Similarly, when a discharge voltage is applied across the third and second electrodes, a luminous discharge is produced in the inner discharge tube, causing the inner discharge tube to produce a light in a color corresponding to the fluorescent material coated on the interior surface of the envelope which is different from the luminous color of the outer discharge tube.

Further, when discharge voltages are applied respectively across the first electrode and the second electrode and across the third electrode and the second electrode at the same time, a luminous discharge is simultaneously produced in both the outer discharge tube and the inner discharge tube, producing a light in a color which is the mixture of the color corresponding to the fluorescent material coated on the interior surface of the envelope of the outer discharge tube and the color corresponding to the fluorescent material coated on the interior surface of the envelope of the inner discharge tube.

Since the plural-color discharge lamp functions as a kind of capacitor having the envelopes serving as dielectric materials, gradual increase or decrease of the discharge voltage applied across the electrodes causes a sweep over the illuminated region of the tubes. The sweeping illumination can be also effected by applying across the electrodes a discharge voltage which is constant and whose frequency is gradually varied.

The present invention will become more fully apparent from the claims and the description as it proceeds in connection with the drawings.

DETAILED DESCRIPTION OF THE PREFERRED EMBODIMENTS

Figure 1:
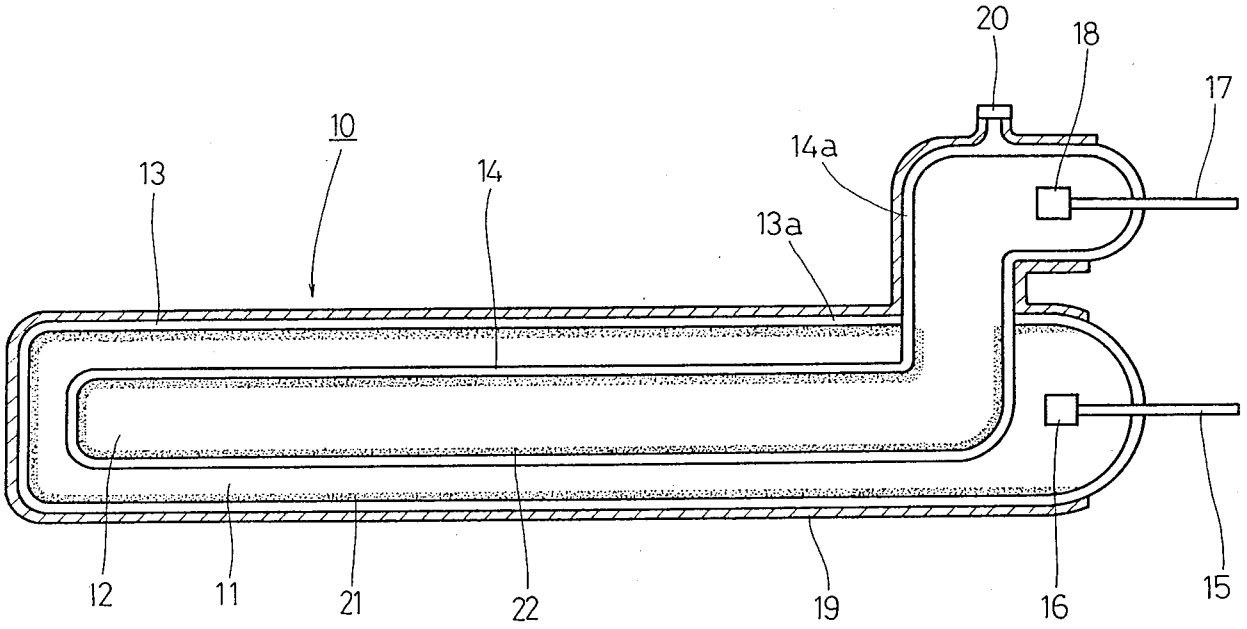
FIG. 1 is a schematic cross-sectional view of a plural-color discharge lamp according to a first embodiment of the present invention.

Referring to the drawings and to FIG. 1 in particular, shown therein and generally designated by the reference character 10 is a plural-color discharge lamp constructed in accordance with a first embodiment of the invention. As shown therein, the discharge lamp 10 includes an outer discharge tube 11 and an inner discharge tube 12. The outer discharge tube 11 includes an elongated cylindrical envelope 13 of dielectric material made up of an interior and an exterior surface defining a cell which may confine gas. The inner discharge tube 12 includes an envelope 14 similar to the envelope 13 of the outer discharge tube 11 but having one end **14*a* of generally recumbent L-shaped configuration. The inner discharge tube 12 is inserted in the outer discharge tube 11, with the end 14***a* of the inner envelope 14 projecting outwardly from one end 13*a* of the outer envelope 13. The envelopes 13 and 14 are made of soft glass such as transparent soda glass, or hard glass such as borosilicate glass. Each of the envelopes 13 and 14 is filled with inert gas such as neon, krypton and xenon at a pressure from several to hundreds mmHg.

An electrode 15 is mounted within the outer envelope 13 at the right end thereof (as viewed in the drawing) and has a getter 16 attached to the extreme end thereof. Similarly, another electrode 17 is mounted within the inner envelope 14 at the projecting end 14*a* thereof and has a getter 18 attached to the extreme end thereof.

In case the envelopes 13 and 14 are made of soft glass, a Dumet wire, for example, is used for the electrodes 15 and 17; in case the envelopes 13 and 14 are made of hard glass, a tungsten wire, for example, is used for the electrodes 15 and 17. The getter 16 attached to the extreme end of the electrode 15 and the getter 18 attached to the extreme end of the electrode 17 serve to adsorb a harmful discharged substance such as harmful gas or impurity, and may be formed of titanium, tantalum, zirconium or the like.

A transparent conductive film 19 is deposited on the exterior surface of the outer envelope 13 and the exterior surface of the projecting end 14*a* of the inner envelope 14 except the parts and vicinity thereof at which the electrodes 15 and 17 protrude outwardly of the respective envelopes. The transparent conductive film 19 serves as an electrode common to the electrodes 15 and 17. A terminal 20 is firmly secured to the exterior surface of the projecting end 14*a* of the inner envelope 14 and adapted to supply a discharge voltage to the transparent conductive film 19 which serves as the common electrode.

The interior surface of the outer envelope 13 is coated with a fluorescent material 21 which produces, for example, a red light when a discharge voltage is applied across the electrode 15 and the terminal 20 for luminous discharge. The interior surface of the inner envelope 14 is coated with another fluorescent material 22 which produces, for example, a green light when a discharge voltage is applied across the electrode 17 and the terminal 20 for luminous discharge.

Figure 2:
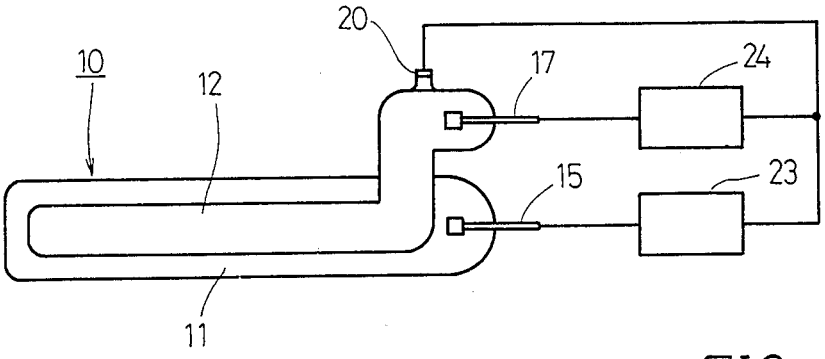
FIG. 2 is a schematic diagram illustrating the connection of the discharge lamp of FIG. 1 with power sources.

As schematically shown in FIG. 2, a discharge power supply 23 is connected to the electrode 15 and the terminal 20, and another discharge power supply 24 is connected to the electrode 17 and the terminal 20. The power supplies 23 and 24 are both adapted to deliver a fixed AC voltage, for instance, in the range of 200 to 2,000 V having a fixed frequency, for instance, in the range of 3 to 30 kHz. Further, the power supplies 23 and 24 may be modified so as to deliver a variable AC voltage or an AC voltage having a variable frequency. In this case, the voltage is variable in the range of 200 to 2,000 V with the lapse of time, and the frequency is variable in the range of 3 to 30 kHz with the lapse of time.

In the plural-color discharge lamp 10 thus constructed, when the above fixed voltage is applied across the electrode 15 and the common electrode 19 through the terminal 20, a luminous discharge is developed in the outer discharge tube 11, producing a red light. When the above fixed voltage is applied across the electrode 17 and the common electrode 19 through the terminal 20, a luminous discharge is developed in the inner discharge tube 12, producing a green light. When the fixed voltage is applied both across the electrode 15 and the common electrode 19 and across the electrode 17 and the common electrode 19 at the same time, a luminous discharge is simultaneously produced both in the outer discharge tube 11 and in the inner discharge tube 12. At this time, as the outer discharge tube 11 produces a red light and the inner discharge tube 12 produces a green light, the discharge lamp 10 produces a yellow light which is a mixture of the red light and the green light.

It is to be noted that the discharge lamp 10 functions as a capacitor having the glass envelopes 13 and 14 as dielectric material. Thus, when the above variable voltage is gradually increased, the illuminated region of the outer discharge tube 11 and/or the inner discharge tube 12 is caused to sweep in a manner varying the length thereof from the electrode 15 and/or the electrode 17. When the variable voltage is kept constant but the frequency thereof is gradually increased, the illuminated region of the outer discharge tube 11 and/or the inner discharge tube 12 is also swept in a manner varying the length thereof from the electrode 15 and/or the electrode 17. Therefore, the direction of sweeping illumination of the outer discharge tube 11 and that of the inner discharge tube 12 are the same.

Figure 3:
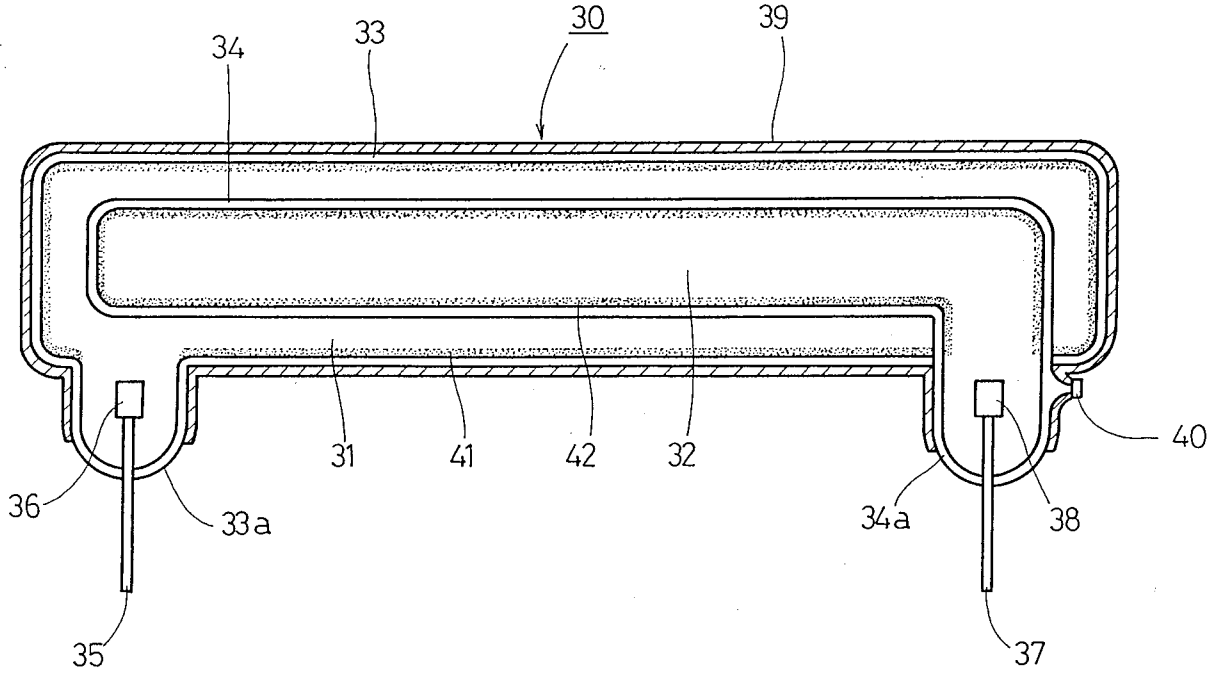
FIG. 3 is a schematic cross-sectional view of a plural-color discharge lamp according to a second embodiment of the present invention.

FIG. 3 shows a second embodiment of the present invention. Basically, the difference in this embodiment is that an electrode 35 corresponding to the electrode 15 of the first embodiment is provided opposite a second electrode 37. With this modified arrangement of electrodes, the direction of sweeping illumination of the outer discharge tube is reverse to that of the inner discharge tube.

As shown in FIG. 3, a discharge lamp 30 has an outer discharge tube 31 and an inner discharge tube 32. The outer discharge tube 31 includes an elongated cylindrical envelope 33 having an integral extention 33*a* adjacent the left end thereof (as viewed in FIG. 3). The inner discharge tube 32 also includes an elongated cylindrical envelope 34 having an integral extention 34*a* adjacent the right end thereof (as viewed in FIG. 3) and remote from the extention 33*a* of the outer envelope 33. The inner discharge tube 32 is inserted in the outer discharge tube 31, with the extention 34*a* of the inner envelope 34 projecting outwardly from the right end (as viewed in FIG. 3) of the outer envelope 33. The envelopes 33 and 34 are made of soft glass such as transparent soda glass, or hard glass such as borosilicate glass, as is the case with the first embodiment. Also, the respective envelopes 33 and 34 are filled with inert gas such as neon, krypton and xenon at a pressure from several to hundreds mmHg.

An electrode 35 is mounted within the extention 33*a* of the outer envelope 33 and has a getter 36 attached to the extreme end thereof. Similarly, another electrode 37 is mounted within the extension 34*a* of the inner envelope 34 and has a getter 37 attached to the extreme end thereof. The electrodes 35 and 37 use a Dumet wire or a tungsten wire, as is the case with the first embodiment.

A transparent conductive film 39 is deposited on the exterior surface of the outer envelope 33 and the exterior surface of the extension 34*a* of the inner envelope 34 except the parts and the vicinity thereof at which the electrodes 35 and 37 protrude outwardly of the respective envelopes. The transparent conductive film 39 serves as an electrode common to the electrodes 35 and 37. A terminal 40 is firmly secured to the exterior surface of the extention 34*a* and adapted to supply a discharge voltage to the transparent conductive film 39 which serves as the common electrode.

The interior surface of the outer envelope 33 is coated with a fluorescent material 41 which produces, for example, a red light when a discharge voltage is applied across the electrode 35 and the terminal 40 for luminous discharge. The interior surface of the inner envelope 34 is coated with another fluorescent material 42 which produces, for example, a green light when a discharge voltage is applied across the electrode 37 and the terminal 40 for luminous discharge.

Figure 4:
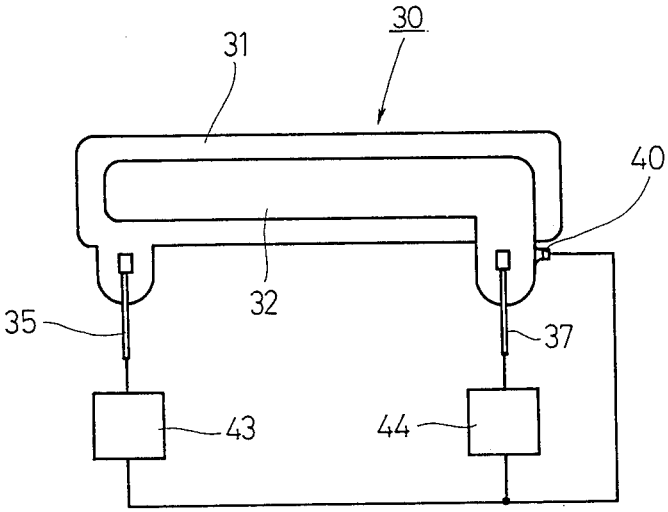
FIG. 4 is a schematic diagram illustrating the connection of the discharge lamp of FIG. 3 with power sources.

As schematically shown in FIG. 4, a discharge power supply 43 is connected to the electrode 35 and the terminal 40, and another discharge power supply 44 is connected to the electrode 37 and the terminal 40. The power supplies 43 and 44 are both adapted to deliver a fixed AC voltage, for instance, in the range of 200 to 2,000 V having a fixed frequency, for instance, in the range of 3 to 30 kHz. Further, the power supplies 43 and 44 may be modified so as to deliver a variable AC voltage or an AC voltage having a variable frequency. In this case, the voltage is variable in the range of 200 to 2,000 V with the lapse of time, and the frequency is variable in the range of 3 to 30 kHz with the lapse of time.

The operation of the second embodiment is substantially the same as that of the first embodiment. However, in the second embodiment the sweeping direction of the illuminated region of the outer discharge tube 31 is reverse to that of the inner discharge tube 32. Specifically, when the above variable voltage is gradually increased, the illuminated region of the outer discharge tube 31 is caused to sweep in a manner varying the length thereof from the electrode 35, and the illuminated region of the inner discharge tube 32 is caused to sweep in a manner varying the length thereof from the electrode 37. When the variable voltage is kept constant but the frequency thereof is gradually increased, the same sweeping illumination may be obtained.

Various applications of the plural-color discharge lamps 10 and 30 will now be described.

Figure 5:
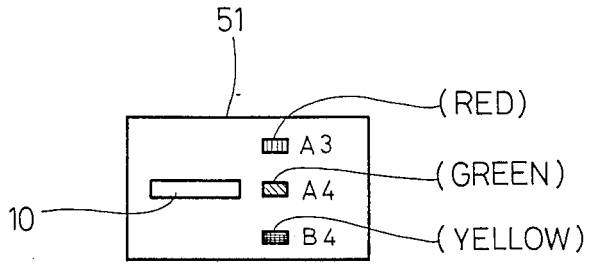
FIGS. 5 to 7 are schematic representations illustrating examples of practical applications of the discharge lamp according to the first embodiment.

As mentioned above, the plural-color discharge lamp 10 can change the luminous color selectively among red, green and yellow during the discharge, and it is featured in that the direction of the sweeping illumination in the outer discharge tube 11 and that in the inner discharge tube 12 are the same. FIG. 5 shows the plural-color discharge lamp 10 used in a paper cassette display panel 51 for a copying machine. Color chips representative of paper sizes are provided adjacent the discharge lamp 10. For example, red corresponds to the paper size A3, green to the paper size A4 and yellow to the paper size B4. Thus, when the size of a selected paper is A3 for example, the discharge lamp 10 produces a red light to indicate that the size of the selected paper is A3, and at the same time, it is swept in the direction of paper feed.

Figure 6:
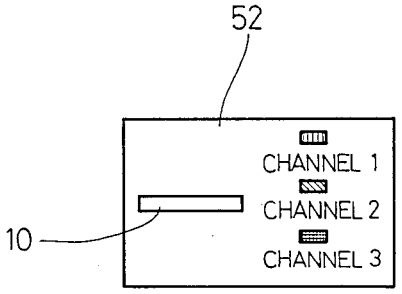
Figure 7:
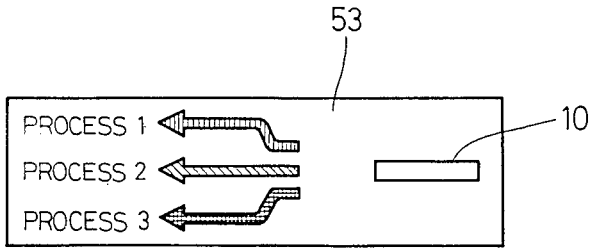

FIGS. 6 and 7 show other applications of the discharge lamp 10 in which movement of articles is displayed on an instrument panel 52 or a material-handling control panel 53. In case of the instrument panel 52 shown in FIG. 6, channels of article travel, that is, CHANNEL 1, CHANNEL 2 and CHANNEL 3 are shown adjacent the discharge lamp 10 in the same luminous colors of the discharge lamp 10, that is, red, green and yellow. When the discharge lamp 10 produces, for example, a red light, it indicates that the articles are travelling in CHANNEL 1. In case of the material-handling control panel 53, processes of article flow, PROCESS 1, PROCESS 2 and PROCESS 3 are shown in the same luminous colors of the discharge lamp 10, that is, red, green and yellow. When the discharge lamp 10 produces, for example, a red light, it indicates that the articles are flowing in PROCESS 1.

Figure 8A:
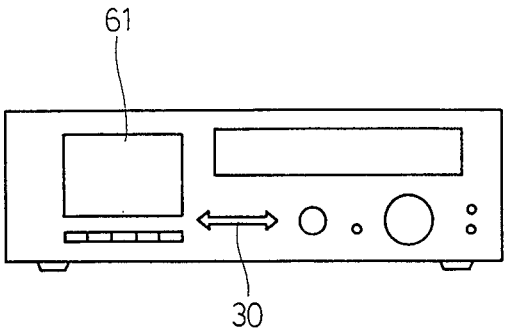
FIGS. 8A, 8B and 9 are schematic representations illustrating examples of practical applications of the discharge lamp according to the second embodiment.
Figure 8B:
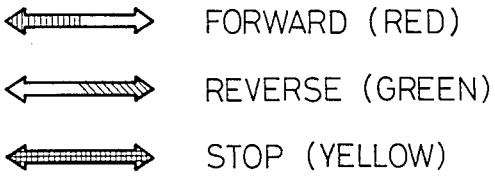

Now, some applications of the plural-color discharge lamp 30 will be explained. As mentioned above, the plural-color discharge lamp 30 can change the luminous color selectively among red, green and yellow during the discharge, and it is featured in that the direction of the sweeping illumination in the outer discharge tube 31 is reverse to that in the inner discharge tube 32. This discharge lamp 30 can be used to display direction of travel of a continuous web such as a magnetic tape and film. FIG. 8A shows the discharge lamp 30 used to display direction of travel of a cassette tape 61. The lamp 30 produces a red light and is swept from right to left, as shown in FIG. 8B, when the cassette tape 61 travels from right to left, or in other words, on recording or reproducing. Conversely, on rewinding, it produces a green light and is swept from left to right, and further, on stopping, it produces a yellow light.

Figure 9:
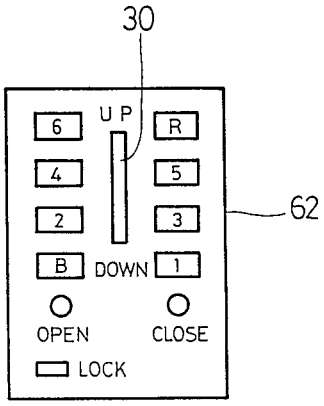

FIG. 9 shows another application of the discharge lamp 30, which is employed for displaying upward and downward movements of an elevator on a display panel 62. For example, red is used to display upward movement of the elevator, and green is used to display downward movement, and a sweeping illumination is effected in the respective directions of movement. Further applications of the discharge lamp 30 may include display of passing directions of a train, indication of insertion and extraction of a telephone card or a cash card, display of forward and reverse runnings of an automobile and display of upward and downward movements of an escalator.

From the foregoing detailed description of the discharge lamps 10 and 30, it can been seen that a single discharge lamp can produce a light in a plurality of colors with sweeping effect, thereby improving the display effect when the luminous discharge is employed for displaying characters, numerals, symbols or the like.

While the present invention has been described with reference to preferred embodiments thereof, it may be understood that modifications of variations may be easily made without departing from the scope of this invention which is defined by the appended claims.

What is claimed is:

1. A plural-color discharge lamp comprising:

an outer discharge tube including an elongated cylindrical envelope of dielectric material, an inert gas confined in said envelope, a first electrode mounted within one end of said envelope, a second electrode formed of a tranparent conductive film deposited substantially on the entire exterior surface of said envelope, and a fluorescent material coated on the interior surface of said envelope and adapted to produce a light in a desired color when a voltage is applied across said two electrodes for luminous discharge; and an inner discharge tube inserted substantially over the entire length thereof in said outer discharge tube, said inner discharge tube including an elongated cylindrical envelope of dielectric material, an inert gas confined in said inner envelope, a third electrode mounted within one end of said inner envelope, said third electrode utilizing said second electrode of said outer discharge tube as an opposite electrode for producing luminous discharge, and a fluorescent material coated on the interior surface of said inner envelope and adapted to produce a light in a color different from the one produced by the fluorescent material coated on the interior surface of said envelope of said outer discharge tube.

2. The plural-color discharge lamp as defined in claim 1 wherein said first electrode mounted within said outer discharge tube and said third electrode mounted within said inner discharge tube are attached to the respective ends of said outer and inner discharge tubes on the same side.

3. The plural-color discharge lamp as defined in claim 1 wherein said first electrode mounted within said outer discharge tube and said third electrode mounted within said inner discharge tube are attached to the respective ends of said outer and inner discharge tubes on the sides opposite to each other.

4. The plural-color discharge lamp as defined in claim 1 wherein each of said first and third and third electrodes has a getter attached to the extreme end thereof.

5. The plural-color discharge lamp as defined in claim 1 wherein said inert gas confined insaid outer and inner discharge tubes is neon.

6. The plural-color discharge lamp as defined in claim 1 wherein said inert gas confined in said outer and inner discharge tubes is krypton.

7. The plural-color discharge lamp as defined in claim 1 wherein said inert gas confined in said outer and inner discharge tubes is xenon.

8. The plural-color discharge lamp as defined in claim 1 wherein said fluorescent material coated on the interior surface of said outer discharge tube is served to produce a red light, and said fluorescent material coated on the interior surface of said inner discharge tube is served to produce a green light.

9. The plural-color discharge lamp as defined in claim 1 wherein said fluorescent material coated on the interior surface of said outer discharge tube is served to produce a green light, and said fluorescent material coated on the interior surface of said inner discharge tube is served to produce a red light.

* * * * *